United States Patent [19]

Denda et al.

[11] Patent Number: 4,951,447

[45] Date of Patent: Aug. 28, 1990

[54] WRAPPING APPARATUS

[75] Inventors: Toshio Denda; Tadashi Takeuchi, both of Tokyo, Japan

[73] Assignee: Teraoka Seiko Co., Limited, Tokyo, Japan

[21] Appl. No.: 422,162

[22] Filed: Oct. 16, 1989

[30] Foreign Application Priority Data

Oct. 20, 1988 [JP] Japan ..... 63-264860

[51] Int. Cl.[5] ..... B65B 11/18

[52] U.S. Cl. ..... 53/502; 53/131; 53/228; 53/556

[58] Field of Search ..... 53/556, 228, 230, 231, 53/226, 222, 223, 502, 131, 389

[56] References Cited

U.S. PATENT DOCUMENTS

| | | | |
|---|---|---|---|
| 3,662,513 | 5/1972 | Fabbri | 53/389 X |
| 3,967,433 | 7/1976 | Bonfiglioli | 53/228 X |
| 4,178,740 | 12/1979 | Groom et al. | 53/556 |
| 4,388,796 | 6/1983 | Zelnick | 53/556 X |
| 4,501,106 | 2/1985 | Treiber et al. | 53/556 X |
| 4,674,269 | 6/1987 | Denda | 53/502 |
| 4,709,531 | 12/1987 | Denda | 53/208 X |
| 4,730,441 | 3/1988 | Terminella et al. | 53/228 X |
| 4,757,451 | 7/1988 | Denda | 53/556 X |
| 4,827,694 | 5/1989 | Owen et al. | 53/556 X |
| 4,884,209 | 11/1989 | Denda | 53/502 X |

*Primary Examiner*—James F. Coan

*Attorney, Agent, or Firm*—Armstrong, Nikaido, Marmelstein, Kubovcik & Murray

[57] ABSTRACT

A wrapping apparatus designed so that an attractively wrapped package is obtained at all times irrespective of the kind of a film used and the shape of a tray selected. Namely, there is provided a wrapping apparatus of the type in which a predetermined cut length of film fed by a film feeding mechanism is extended at a predetermined portion of the wrapping apparatus, an article to be wrapped is raised into engagement with the extended film from therebelow by an elevator mechanism, and the edges of the film are folded under the bottom of the article, thereby wrapping the article in the film, by a film folding mechanism comprising left and right folding members and either a front or rear folding member, wherein an article mount section of the elevator mechanism has at least left and right head portions disposed at the left and right sides, respectively, and each constituted by a plurality of heads.

10 Claims, 10 Drawing Sheets

| TYPE OF TRAY / OPERATION TIMING | LONG TRAY (SLENDER TRAY) | STANDARD TRAY | APPROXIMATELY SQUARE TRAY |
|---|---|---|---|
| LEFT AND RIGHT FOLDING PLATES | t1 | t2 | t3 |
| REAR FOLDING ROLLER | t4 | t5 | t6 |

Fig. 8

WRAPPING APPARATUS

BACKGROUND OF THE INVENTION

This invention relates to a wrapping apparatus in which articles are wrapped in a stretchable film or the like on a tray-by-tray basis.

As one type of wrapping apparatus in which article accommodated in individual tray-shaped containers (hereinafter referred to simply as trays) are each wrapped in a transparent stretchable film, there has heretofore been a wrapping apparatus in which a predetermined cut length of film fed by a film feeding mechanism is extended at a predetermined portion of the wrapping apparatus, an article to be wrapped is raised into engagement with the extended film from therebelow by an elevator mechanism, and the edges of the film are folded under the bottom of the article by left and right folding plates and a front or rear folding plate, having respective independent drive means, in such a manner that the left and right edges of the film are first folded under the bottom of the tray and the front or rear edge of the film is then folded under the bottom of the tray by starting the left and right folding plates in advance of the starting of the front or rear folding plate, thereby wrapping the article in the film with the film edges being beautifully folded under the bottom of the tray.

However, since trays vary in size and shape, the final appearance of the wrapped articles depends upon the type of tray and the prior art suffers from problems, for example, wrinkles in the film covering the tray surface.

To cope with the problems, a wrapping apparatus disclosed in the specification of Japanese Patent Application Laid-Open Publication (KOKAI) No. 61-190408 is arranged such that the start timing of left and right folding members that is in advance of the start timing of a front folding member is controlled in accordance with the cut length of film that is set depending upon the type of a tray selected.

However, attention has recently been paid to the problem regarding the food hygiene of vinyl chloride film and consequently polyethylene film has increasingly been used in place of vinyl chloride film.

Polyethylene film is lower in the level of adhesion to the tray and higher in the level of restoring force produced when stretched than vinyl chloride film. Therefore, when a tray which has a high length-to-width ratio (e.g., a slender tray) is to be wrapped in a film having different properties from those of vinyl chloride film, since the front (rear) folding member folds the front (rear) edge of the film under the bottom of the tray after the left and right folding members have folded the left and right edges of the film deep under the bottom of the tray, the film is forced toward the center of the tray, resulting in wrinkles extending radially from the center.

In addition, since an unnecessarily high tension is applied to the film, the tray may become warped. Since the restoring force of the film when pulled is strong and the level of adhesion to the tray is low, when the grippers grasping both edges of the film are released, wrinkles are produced by restoration of the warped tray and slacking of the film.

Thus, the prior art wrapping apparatus has heretofore been incapable of coping with the problems when a film having different properties from those of a specific one is employed. The applicant of the present application has already developed and filed "Film Folding Mechanism of Wrapping Machine" (Japanese Patent Application No. 62-211707). With this mechanism, however, the above-described problems have not yet been satisfactorily solved.

SUMMARY OF THE INVENTION

In view of the above-described problems of the prior art, it is a primary object of the present invention to provide a wrapping apparatus designed so that an attractively wrapped package is obtained at all times irrespective of the kind of film used and the shape of the tray selected.

To this end, the present invention provides a wrapping apparatus of the type in which a predetermined cut length of film fed by a film feeding mechanism is extended at a predetermined portion of the wrapping apparatus, an article to be wrapped is raised into engagement with the extended film from therebelow by an elevator mechanism, and the edges of the film are folded under the bottom of the article, thereby wrapping the article in the film, by a film folding mechanism comprising left and right folding members and either a front or rear folding member, the wrapping apparatus comprising: an article mount section of the elevator mechanism which has at least left and right head portions disposed at the left and right sides, respectively, and each constituted by a plurality of heads; at least one head among the heads constituting each of the left and right head portions which is closer to the front or rear folding member being arranged such that it can be tilted up to a predetermined angle by the corresponding one of the left and right folding members and either the front or rear folding member; and means for executing the starting of at least the left and right folding members and the front or rear folding member at different timings in accordance with the geometry of a tray selected to accommodate an article to be wrapped, whereby the timing at which the left and right folding members and the front or rear folding member advance to the bottom of the tray is made substantially constant irrespective of the shape of the tray.

The means for executing the starting of the left and right folding members and the front or rear folding member at different timings comprises: setting means for setting start timings of the left and right folding members and the front or rear folding member on the basis of preset geometric data for trays; and selecting mean for selecting start timings set by the setting means in accordance with the type of a tray selected.

If a tray which has a high length-to-width ratio is selected, the start timing of the left and right folding members is delayed with respect to the start timing of the front or rear folding member.

At least the heads constituting the left and right head portions of the elevator mechanism are arranged such that these heads can be tilted up to a predetermined angle by the left and right folding members and either the front or rear folding member in respective directions which are at approximately 45° to the directions in which the left and right folding members and the front or rear folding member advance, respectively.

The film in which the article is wrapped is a polyethylene film.

BRIEF DESCRIPTION OF THE DRAWINGS

1 is a plan view, FIG. 2 is a view (as seen from the direction of the arrow A in FIG. 1), and FIG. 3 is a front view (as seen from the direction of the arrow B in FIG. 1).

FIGS. 4(B) and 4(C) show the arrangement of each individual head.

FIG. 8 shows the operation timings of the left and right folding plates and the rear folding roller, the operation timings being set in accordance with the type of tray.

DESCRIPTION OF THE PREFERRED EMBODIMENT

One embodiment of the present invention will be described below in detail with reference to the accompanying drawings.

Figure 1:
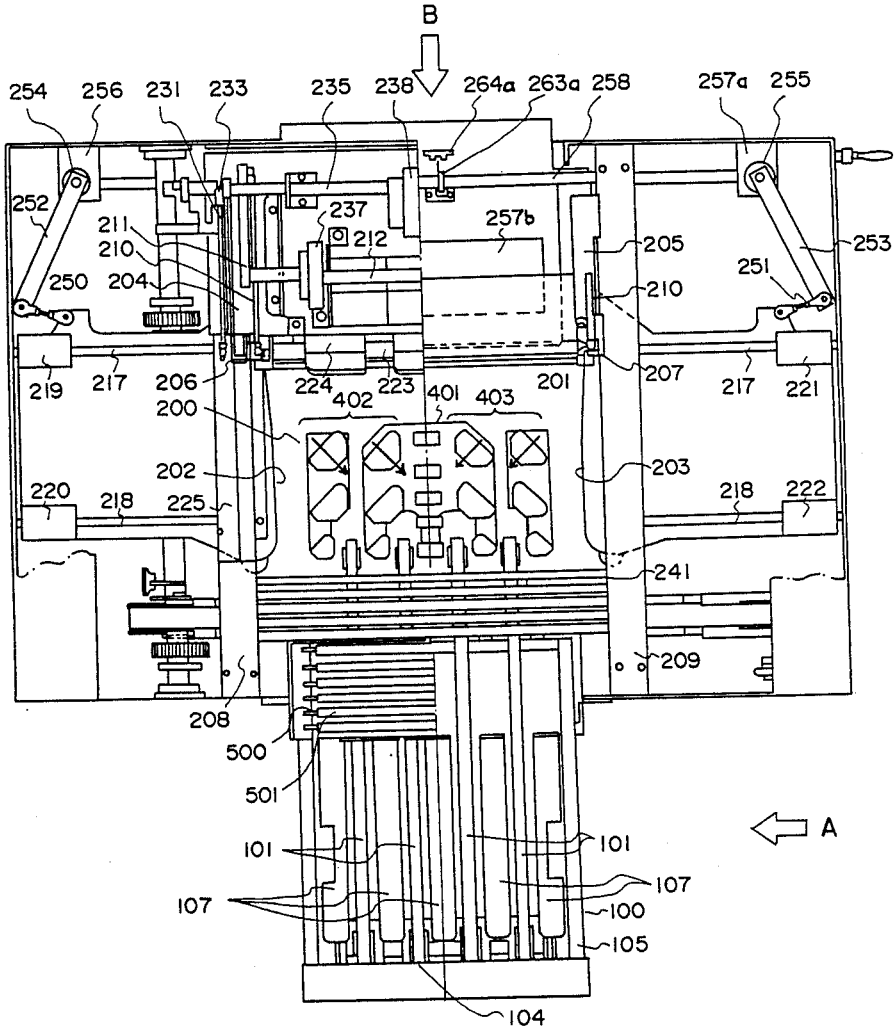
FIGS. 1 to 3 show in combination the wrapping apparatus according to the present invention, in which: FIG.
Figure 2:
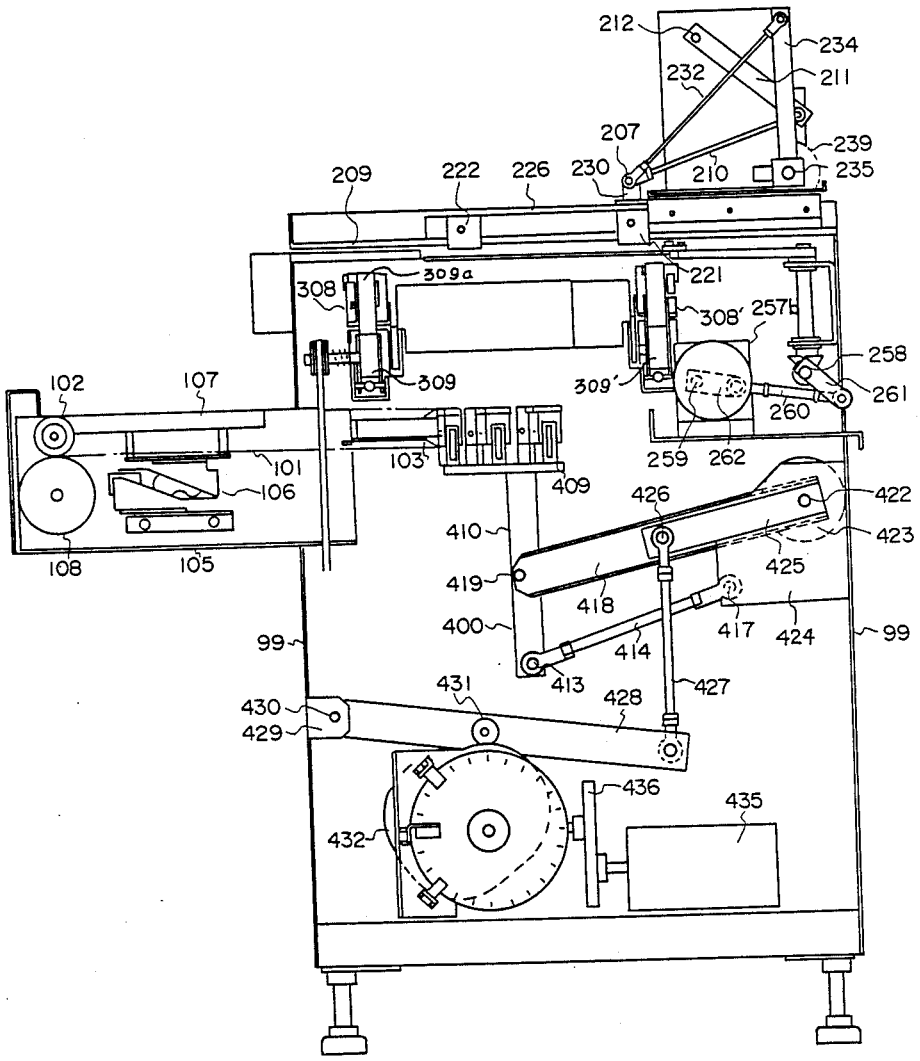
Figure 3:
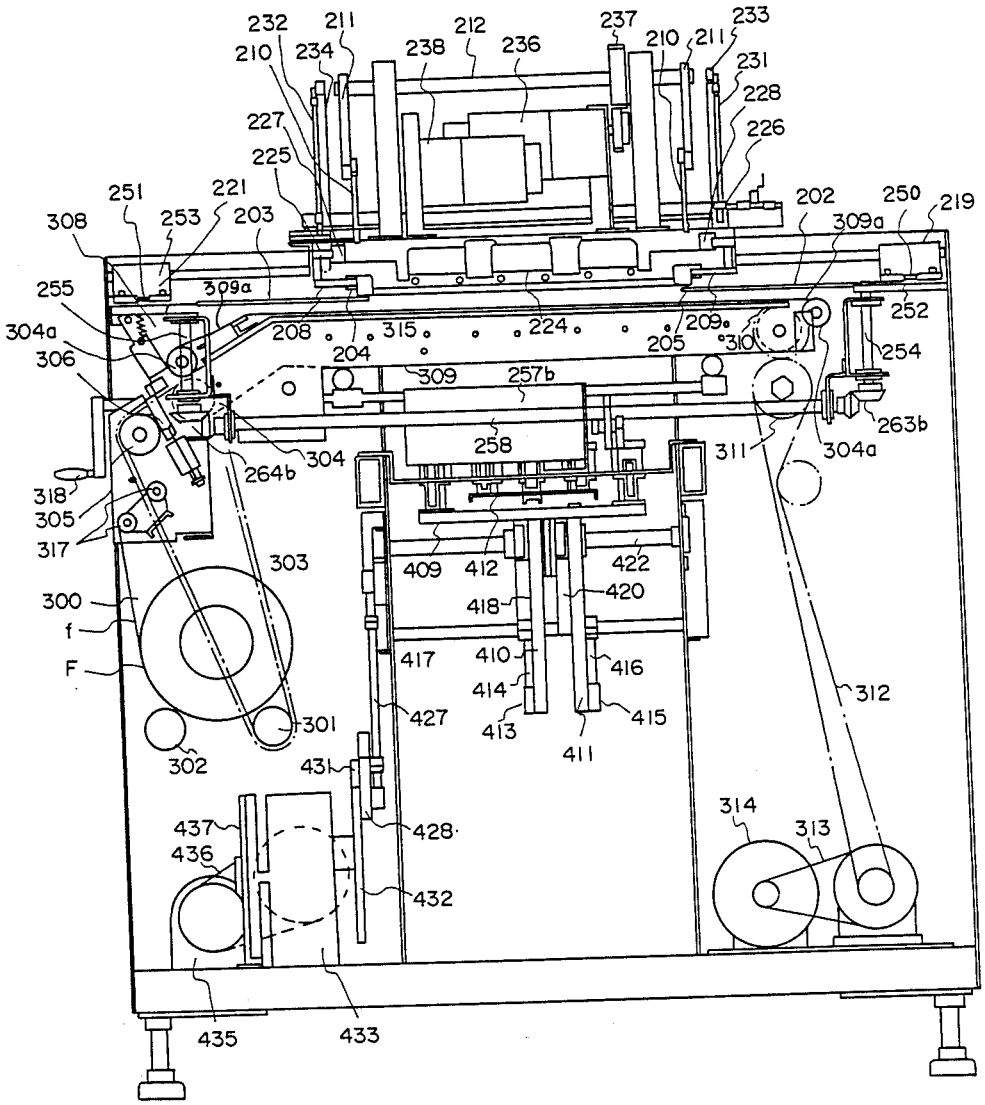

FIGS. 1 to 3 show in combination the wrapping apparatus according to the present invention, in which: FIG. 1 is a plan view, FIG. 2 is a side view (as seen from the direction of the arrow A in FIG. 1), and FIG. 3 is a front view (as seen from the direction of the arrow B in FIG. 1).

The wrapping apparatus comprises an infeed section 100 for feeding in articles which are to be wrapped, a wrapping section 200 for wrapping articles, a film feeding section 300 for feeding a stretchable film, an elevator mechanism 400 for raising an article to be wrapped, and an outfeed section 500 for feeding out the article which has been wrapped.

An article to be wrapped which is fed in from the infeed section 100 is placed on an article mount provided at the top of the elevator mechanism 400 and then raised by the elevator mechanism 400.

The wrapping section 200 is located above the elevator mechanism 400. A film which has been cut into a predetermined length is fed from the film feeding section 300 and extended tautly in the wrapping section 200. The article that is raised by the elevator mechanism 400 pushes up the film from therebelow.

In this state, a film folding mechanism (described later) comprising a rear folding roller, left and right folding plates and so forth, which is provided in the wrapping section 200, is activated to fold the edges of the film under the bottom of the article, thereby wrapping the article in the film.

The wrapped article is fed out of the wrapping apparatus from the outfeed section 500. The structure and operation of each section of the wrapping apparatus will be explained below in detail.

In the infeed section 100 is disposed a pusher conveyor 104 comprising a plurality of pusher belts 101 having pushers for pushing out an article to be wrapped and driving and driven pulleys 102 and 103 which are provided at two ends, respectively, of the pusher belts 101 to stretch them therebetween.

The pusher conveyor 104 is secured to a machine frame 99 of the wrapping apparatus through an infeed section frame member 105. Between each pair of adjacent pusher belts 101 of the pusher conveyor 14 is disposed a scale pan 107 constituting part of a weight detecting section 106 for detecting the weight of the article to be wrapped, the scale pan 107 slightly projecting from the pusher belts 101. The driving pulley 102 is rotated by a gear 108 which rotates in response to the rotation of a motor which is provided independently of motors used to drive other portions of the wrapping apparatus.

When an article to be wrapped is placed on the scale pans 107 of the pusher conveyor 104, the aforementioned motor is driven in response to a measurement stabilizing signal from the weight detecting section 106, whereby the driving pulley 102 is rotated through the gear 108 and the article placed on the scale pans 107 is thereby conveyed by the pusher belts 101.

An article mount (hereinafter referred to as "elevator head section") of the elevator mechanism 400 is located at the inner end of the group of pusher belts 101 in the infeed section 100.

The elevator head section comprises a central head portion 401 which is located in the center and left and right head portions 402 and 403 which are located at the left and right sides, respectively, of the central head portion 401.

Figure 4:
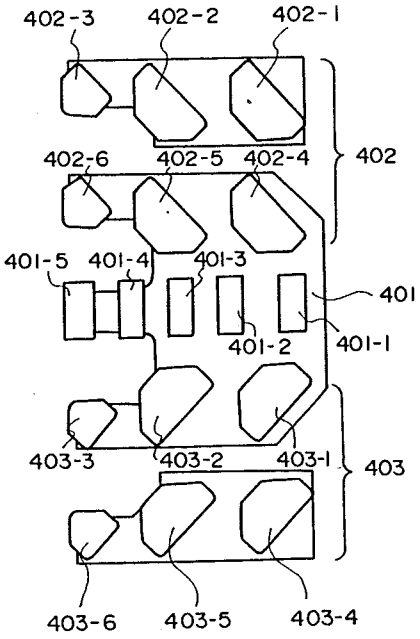
FIG. 4 (A) is a plan view showing the arrangement of the article mount section of the elevator mechanism.
Figure 4:
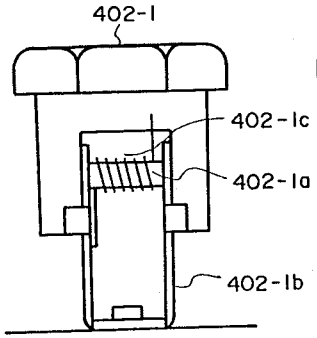
Figure 4:
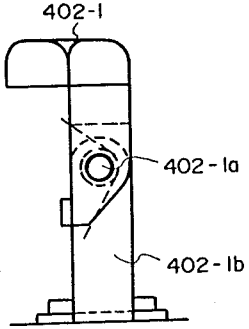

As shown in FIG. 4(A), the central head portion 401 is comprised of five heads 401-1 to 401-5, the left head portion 402 of six heads 402-1 to 402-6, and the right head portion 403 of six heads 403-1 to 403-6.

Each head, for example, the head 402-1, is tiltably supported on a support member **402-1*b* through a pin 402-1*a* and biased in a predetermined direction by a spring 402-1*c*. When the head 402-1 is pushed against the resilient force from the spring 402-1*c*, the head 402-1 pivots so as to tilt about the pin 402-1*a*. Since the structures of the other heads are substantially the same as that of the head 402-1**, description thereof is omitted.

The heads 402-1 to 402-6 and 403-1 to 403-6 that constitute the left and right head portions 402 and 403 are disposed so that each of these heads can tilt in a direction which is at approximately 45° to each of the directions of the arrows shown in FIG. 1, that is, the directions in which left and right folding plates and a rear folding roller (described later) advance, respectively. The heads 401-1 to 401-5 of the central head portion 401 are adapted to be tiltable in the direction in which the rear folding roller 201 advances.

The heads 401-1 to 401-5 of the central head portion 401 and the heads 402-4 to 402-6 and 403-1 to 403-3 of the left and right head portions 402 and 403 are supported by a support plate 412 which is secured to the upper end of a head support rod 410. The heads 402-1 to 402-3 of the left head portion 402 and the heads 403-4 to 403-6 of the right head portion 403 are supported by a support plate 409 which is secured to the upper end of a head support rod 411.

The lower end of the head support rod 410 is pivotally supported through a pin 413 at the forward end of a connecting rod 414. Similarly, the lower end of the head support rod 411 is pivotally supported through a pin 415 (not shown) at the forward end of a connecting rod 416. The other end of the connecting 414, that is, the end thereof which is remote from the pin 413, is pivotally supported through a shaft 417.

The approximately central portion of the head support rod 410 is pivotally supported by the forward end portion of a lever 418 through a pin 419. Similarly, the approximately central portion of the head support rod 411 is pivotally supported by the forward end portion of a lever 420 through a pin 421 (not shown).

The rear end portion of the lever 418 is secured to a shaft 422, whereas the rear end portion of the lever 420 is pivotally supported by the shaft 422.

An electromagnetic clutch 423 is provided on the shaft 422 near the rear end portion of the lever 420 so that rotational force from the shaft 422 is transmitted to the lever 420 by activating the electromagnetic clutch 423. Both ends of the shaft 422 are rotatably supported by respective brackets 424 secured to the machine frame 99.

One end of a lever 425 is secured to one end of the shaft 422, and the other end of the lever 425 is pivotally supported through a pin 426 at one end of a connecting rod 427. The other end of the connecting rod 427 is pivotally supported at one end of a lever 428, and the other end of the lever 428 is pivotally supported through a pin 430 by a bracket 429 which is secured to the machine frame 99.

A cam follower 431 is rotatably supported on the approximately central portion of the lever 428 such that a cam 432 is engaged with the cam follower 431.

The cam 432 is secured to a rotating shaft 434 of a speed reducer 433 to which rotational force is transmitted from a motor 435 via a belt 436 to reduce the number of revolutions of the motor 435 at a predetermined reduction ratio. In addition, a timing disk 437 is attached to the speed reducer 433 in such a manner that the timing disk 437 rotates in response to the rotation of the rotating shaft of the speed reducer 433.

In the elevator mechanism 400 having the above-described arrangement, as the motor 435 rotates, the cam 432 rotates through the speed reducer 433, causing the lever 428 to pivot up and down about the pin 430. The vertical pivotal motion of the lever 428 causes the shaft 22 to rotate back and forth through the connecting rod 427 and the lever 425.

The rotation of the shaft 422 causes the lever 418 to pivot up and down about the shaft 422.

In response to the vertical pivotal motion of the lever 418, the central head portion 401 and the heads 402-4 to 402-6 and 403-1 to 403-3 of the left and right head portions 402 and 403 are raised and lowered through the head support rod 410. When the electromagnetic clutch 423 is activated, the rotational force of the shaft 422 is transmitted to the lever 420, so that the heads 402-1 to 402-3 of the left head portion 402 and the heads 403-4 to 403-6 of the right head portion 403 are also raised and lowered through the head support rod 411.

The wrapping section 200 is located above the elevator mechanism 400. The wrapping section 200 has a rear folding roller 201, a left folding plate 202, a right folding plate 203 and a front folding roller 241.

The rear folding roller 201 is rotatably supported at both ends by the respective ends of sliding members 204 and 205. The sliding members 204 and 205 are adapted to slide along respective guide rails 208 and 209.

One ends of connecting rods 210 and 210' are pivotally supported by respective brackets 206 and 207, and the other ends of the connecting rods 210 and 210' are pivotally supported at the respective ends of cranks 211 and 211'. The other ends of the cranks 211 and 211' are secured to two ends, respectively, of a shaft 212.

Each of the left and right folding plates 202 and 203 has a pair of rods 217 and 218. The rods 217 and 218 of the left folding plate 202 are secured to sliding members 219 and 220, respectively, while the rods 217 and 218 of the right folding plate 203 are secured to sliding members 221 and 222, respectively. The left and right folding plates 202 and 203 are pivotally supported by the respective ends of levers 252 and 253 through links 250 and 251.

The other ends of the levers 252 and 253 are secured to shafts 254 and 255 pivotally supported on brackets 256 and **257*a***.

A left-right folding plate driving motor **257*b* has a rotating shaft 259 to which one end of a lever 262 is secured. The other end of the lever 262 is linked to one end of a lever 261 through a link 260. The other end of the lever 261 is secured to a connecting shaft 258. Rotational force from the connecting shaft 258 is transmitted to the shafts 254 and 255 via bevel gears 263*b* and 264*b* which are provided at both ends, respectively, of the connecting shaft 258**.

Accordingly, as the left-right folding plate driving motor **257*b* is driven in a predetermined direction, driving force produced by the motor 257*b* is transmitted to the connecting shaft 258 via the lever 262, link 260, lever 261 and bevel gears 263*b* and 264*b*, causing the connecting shaft 258 to rotate, and the rotational force from the connecting shaft 258 is transmitted to the shafts 254 and 255**.

The rotation of the shaft 254 is transmitted to the left folding plate 202 via the lever 252 and the link 250, while the rotation of the shaft 255 is transmitted to the right folding plate 203 via the lever 253 and the link 251, and the left and right folding plates 202 and 203 are thus moved along the rods 217 and 218 through the sliding members 221 and 222, respectively.

It should be noted that a flag **263*a* is secured to the approximately central portion of the connecting shaft 258 and a detecting element 264*a* for detecting the flag 263*a* is provided on the machine frame 99**.

Control of the rotation of the left and right folding plate driving motor **257*b* is effected by detecting the flag 263*a* with the detecting element 264*a* at two positions. More specifically, at one position, the initial position of the left and right folding plates 202 and 203 is detected; at the other position, the position at which the left and right folding plates 202 and 203 are returned by reversing the left-right folding plate driving motor 257*b*** is detected.

Guide rails 225 and 226 are disposed above the guide rails 208 and 209. On the guide rails 225 and 226 are slidably fitted sliding members 227 and 228, respectively, which are secured to both ends, respectively, of a mounting plate 223.

A pusher 224 is attached to the forward end of the mounting plate 223 for discharging an article which has been wrapped. The forward ends of connecting rods 231 and 232 are pivotally supported through respective brackets at both ends of the mounting plate 223. The other ends of the connecting rods 231 and 232 are pivotally supported by respective cranks 233 and 234. The other ends of the cranks 23 and 234 are secured to a shaft 235.

To the shaft 212 is transmitted rotational force from a rear folding roller driving motor 236 via a gear 237, and to the shaft 235 is transmitted rotational force from a discharge pusher driving motor 238 via a gear 239.

In the wrapping section 200 having the foregoing arrangement, driving force produced by the rear folding roller driving motor 236 is transmitted to the brackets 206 and 207 via the connecting rods 210 and 210' through the pivotal motion of the cranks 211 and 211' attached to both ends, respectively, of the shaft 212. In consequence, the sliding members 204 and 205 advance along the respective guide rails 208 and 209, thus causing the rear folding roller 201 to advance.

On the other hand, driving force produced by the left-right folding plate driving motor **257*b* is transmitted to the connecting shaft 258 via the lever 262, link 260, lever 262 and the bevel gears 263*b* and 264*b*, causing the connecting shaft 258 to rotate. The rotational force from the connecting shaft 258 is transmitted to the shafts 254 and 255 to cause the left and right folding plates 202 and 203 to advance in mutually opposing directions through the combination of the lever 252 and the link 250 and the combination of the lever 253 and the link 251**, respectively.

As the rear folding roller driving motor 236 is reversed, the rear folding roller 201 is withdrawn by the operation reverse to the above. As the left-right folding plate driving motor **257*b* is reversed, the left and right folding plates 202 and 203** move away from each other.

The pusher 224 is driven by the discharge pusher driving motor 238. More specifically, as the motor 238 is driven, driving force therefrom is transmitted to the sliding members 227 and 228 via the connecting rods 231 and 232 through the pivotal motion of the cranks 233 and 23 attached to both ends, respectively, of the shaft 235, whereby the pusher 224 attached to the forward end of the mounting plate 223 is advanced. When the discharge pusher driving motor 238 is reversed, the pusher 24 is withdrawn by the operation reverse to the above.

An article which has been wrapped is discharged onto a heater roller 501 in the outfeed section 500 by the operation of the pusher 224, and the front edge portion of the film is folded under the bottom of the article by the action of the front folding roller 241.

In the film feeding section 300 are disposed support rollers 301 and 302 for supporting a roll of stretchable film F, the support rollers 301 and 302 being rotatably supported at both ends thereof.

The support roller 301 is rotated through a pulley 305 by rotational force transmitted thereto via a belt 303. The pulley 305 is mounted together with a delivery roller 305' (not shown) in one unit, the roller 305' being adapted to deliver a film f from the roll of stretchable film F.

A cutter 306 is disposed between the pulleys 304 and 305 to cut the film f unreeled from the roll of stretchable film F into a predetermined length.

In front of the pulley 304 are disposed film conveying mechanism 308 and 308' adapted to convey a predetermined cut length of film while clamping two edges, respectively, of the film.

The film conveying mechanism 308 has a main film conveying belt 309 and a follower belt **309*a*. The main film conveying belt 309 is stretched between a driving pulley 310 and the aforementioned pulley 304. The follower belt 309*a* is stretched between pulleys 304*a* disposed at both ends, respectively, of the belt 309*a*. The follower belt 309*a* is disposed in contact with the upper surface of the main film conveying belt 309. The arrangement of the film conveying mechanism 308' is substantially the same as that of the film conveying mechanism 308**.

The driving pulley 310 is rotated by a motor 314 via a gear 311, a chain 312 and a belt 313.

Accordingly, the film is conveyed while being embraced by the main film conveying belt 309 and the follower belt **309*a***.

It should be noted that the reference numeral 317 in FIG. 3 denotes two tension rollers for applying a predetermined level of tension to the film, the rollers being urged to rotate clockwise.

The reference numeral 318 denotes a spacing adjusting handle used to adjust the spacing of the film conveying belts 309 and 309' in conformity with the width of the roll of stretchable film F used.

In the wrapping apparatus arranged detailed above, the film f unreeled from the roll of stretchable film F in the film feeding section 300 is passed along the surfaces of a pair of tension rollers 317 and led to the area between the main film conveying belt 309 and the follower belt **309*a* through the film delivery pulley 305'**.

After a predetermined amount of film f has been conveyed, the cutter 306 is activated to cut the film f into a predetermined length.

The film f cut into a predetermined length stands by at a predetermined position in the wrapping section 200 above the elevator mechanism 400 while being clamped a both longitudinally extending edge portions between the main film conveying belt 309 and the follower belt **309*a*** with a stronger force.

On the other hand, an article to be wrapped which is placed on the pusher belts 101 constituting the pusher conveyor 104 in the infeed section 100 is conveyed onto the elevator head section of the elevator mechanism 400 in response to a measurement stabilizing signal from the weight detecting section 106 or a detecting signal from an article detector (not shown).

Next, the elevator mechanism 400 is driven to raise the article to be wrapped. In this case, the heads 401-1 to 401-5 constituting the central head portion 401, the heads 402-4 to 402-6 constituting the left head portion 402 an the heads 403-1 to 403-3 constituting the right head portion 403 are always raised and lowered. However, the heads 402-1 to 402-3 constituting the left head portion 40 and the heads 403-4 to 403-6 constituting the right head portion 403 are raised and lowered depending upon the length of the article to be wrapped or the cut length of the film, that is, if the length of the article or the cut length of the film is greater than a predetermined value, the electromagnetic clutch 423 is activated to raise and lower these heads, whereas, if the length of the article or the cut length of the film is not greater than the predetermined value, the electromagnetic clutch 423 is not activated and only the heads 401-1 to 401-5, 402-4 to 402-6 and 403-1 to 403-3 are raised and lowered.

Figure 5:
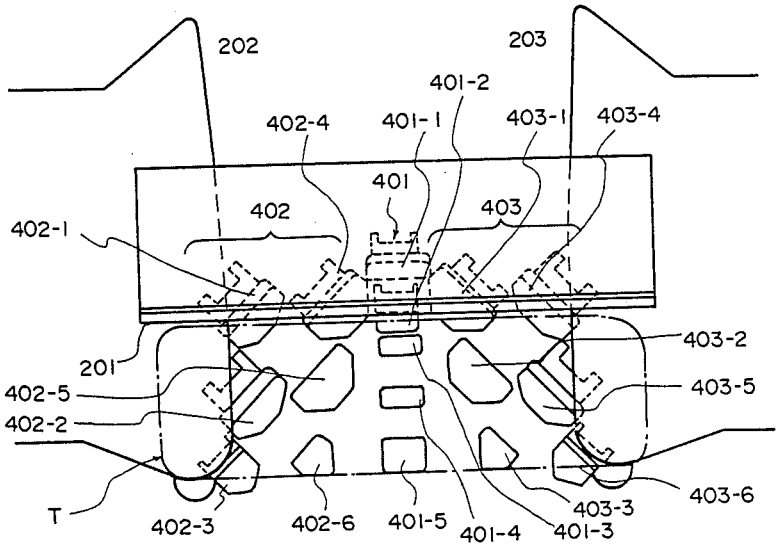
FIGS. 5(A), 5(B) and 5(C) are views employed to describe the operations of the wrapping section conducted to wrap trays types, respectively.
Figure 5:
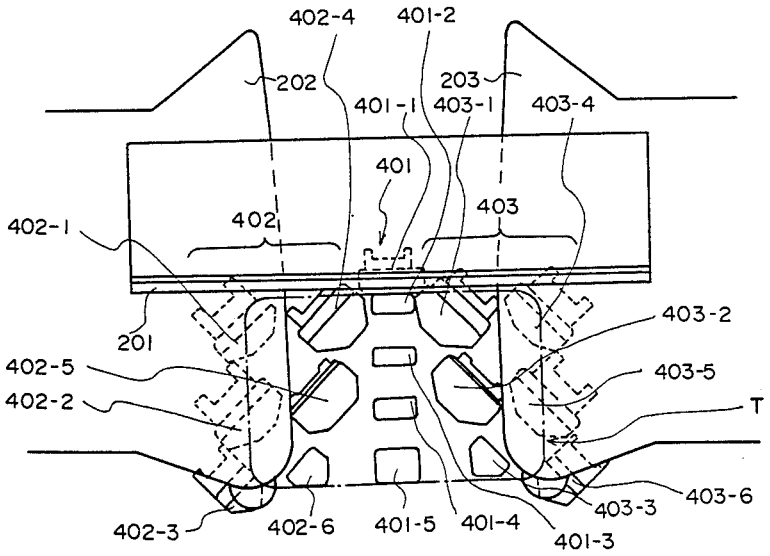
Figure 5:
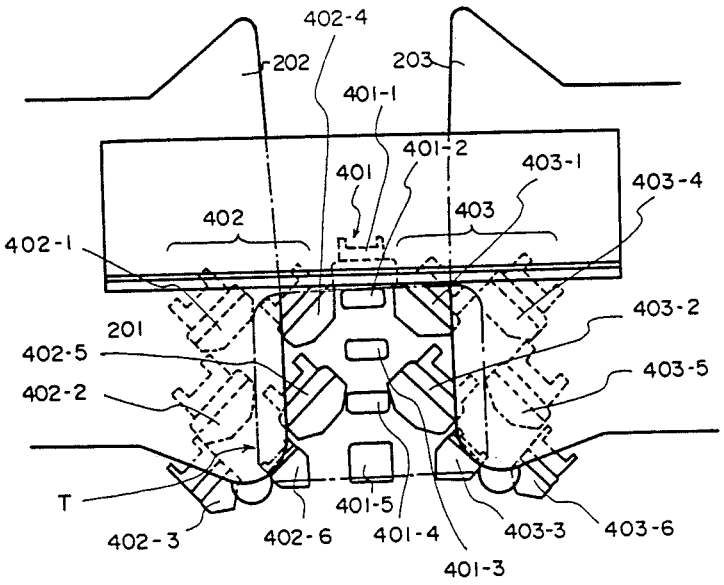

The operations of the rear folding roller 201, the left and right folding plates 202 and 203, the heads 401-1 to 401-5 constituting the central head portion 401 and the heads 402-1 to 402-6 and 403-1 to 403 6 constituting the left and right head portions 402 and 403 in a case where articles accommodated in various trays are wrapped in the above-described wrapping apparatus will next be explained with reference to FIG. 5.

FIG. 5(A) is a view employed to describe the operation of wrapping an article which is accommodated in a tray, for example, a slender tray, which has a high length-to-width ratio.

As illustrated, a tray T is placed on the central head portion 401 and left and right head portions 402 and 403 of the elevator head section in the elevator mechanism 400.

Next, the left-right folding plate driving motor 257*b* is started to move the left and right folding plates 202 and 203 in mutually opposing directions.

The rear folding roller driving motor 236 is started at such a timing that the rear folding roller 201 reaches the bottom of the tray T slightly after the edge portions of the film which are at the left and right sides, respectively, of the tray T are folded under the bottom of the tray T by the left and right folding plates 202 and 203.

Accordingly, before an unnecessarily high tension is applied to the left and right edges of the film by the left and right folding plates 202 and 203, the edge portion of the film which is at the rear of the tray T can be folded under the bottom of the tray T and the front edge of the film can be folded under the bottom of the tray T simultaneously with discharging of the tray T, thereby wrapping the article in the film.

Thus, in the case of a tray which has a high length-to-width ratio, the start of the left and right folding plates 202 and 203 is delayed with respect to the start of the rear folding roller 201, thereby attaining the above-described purpose.

At this time, the rear heads 402-1, 402 4, 403-1 and 403-4 of the left and right head portions 402 and 403 are tilted in the respective directions which are at 45° to the front folding roller 241, while the heads 402-2, 403-5, 402-3 and 403-6 are tilted by the left and right folding plates 202 and 203 in the respective 45° directions, and the rear heads 401-1 and 401-2 of the central head portion 401 are tilted toward the front folding roller 241. As the left and right folding plates 202, 203 and the rear folding roller 201 further move and when the rear folding roller 201 folds the film under the bottom of the tray T, the heads 402-5 and 403-2 are also tilted by the rear folding roller 201 in the respective 45° directions. The remaining central heads are tilted by the rear folding roller 201, while the heads 402-6 and 403-3 are tilted by the left and right folding plates 202 and 203, successively.

FIG. 5(B) is a view employed to describe the operation of wrapping an article accommodated in a standard tray.

In the case of a standard tray T also, the rear folding roller driving motor 236 is started at such a timing that the rear folding roller 201 reaches the bottom of the tray T slightly after the film is folded under the bottom of the tray T by the left and right folding plates 202 and 203.

At this time, the heads 402-4 and 403-1 of the left and right head portions 402 and 403 are tilted by the rear folding roller 201, while the heads 402-1, 402-2, 402-3, 403-4, 403-5 and 403-6 are tilted by the left and right folding plates 202 and 203, as illustrated.

Simultaneously with the movement of the left and right folding plates 202 and 203, the rear edge of the film is folded under the bottom of the tray T by the action of the rear folding roller 201.

FIG. 5(C) is a view employed to describe the operation of wrapping an article accommodated in an approximately square tray having a low length-to-width ratio.

In the case of an approximately square tray also, the rear folding roller driving motor 236 is started at such a timing that the rear folding roller 201 reaches the bottom of the tray T slightly after the film is folded under the bottom of the tray T by the left and right folding plates 202 and 203.

In the case of an approximately square tray T, as illustrated, the heads 402-4 and 403-1 of the left and right head portions 402 and 403 are tilted by the left and right folding plates 202, 203 and the rear folding roller 201 substantially at the same time. It should be noted that, in the case of an approximately square tray having a large size (e.g., a jumbo tray) also, the left-right folding plate driving motor 257*b* is started at a timing similar to the above.

As shown in FIGS. 5(A), 5(B) and 5(C), the timing at which the left and right folding plates 202, 203 and the rear folding roller 201 fold the film under the bottom of the tray T is substantially the same irrespective of the shape (length-to-width ratio) of the tray.

The start of the left-right folding plate driving motor 257*b* is controlled in accordance with the length-to-width ratio so that the film is folded under the bottom of the tray at the timing described above.

Thus, the elevator head section of the elevator mechanism 400 comprises left and right head portions 402 and 403 constituted by a plurality of heads and disposed at the left and right sides, respectively, and a central head portion 401 similarly constituted by a plurality of heads and disposed in the center, and the heads constituting the left and right head portions 402, 403 and the central head portion 401 can be tilted up to a predetermined angle by the left and right folding plates 202, 203 and the rear folding roller 201 in the respective directions which are at approximately 45° to the directions of advancement of the left and right folding plates 202, 203 and the rear folding roller 201. Accordingly, heads can be disposed at a high density without interference with heads disposed in the respective tilting directions and it is therefore possible to reduce the warp of the tray by the tension acting on the film and hence eliminate the fear of the tray being broken.

Figure 6:
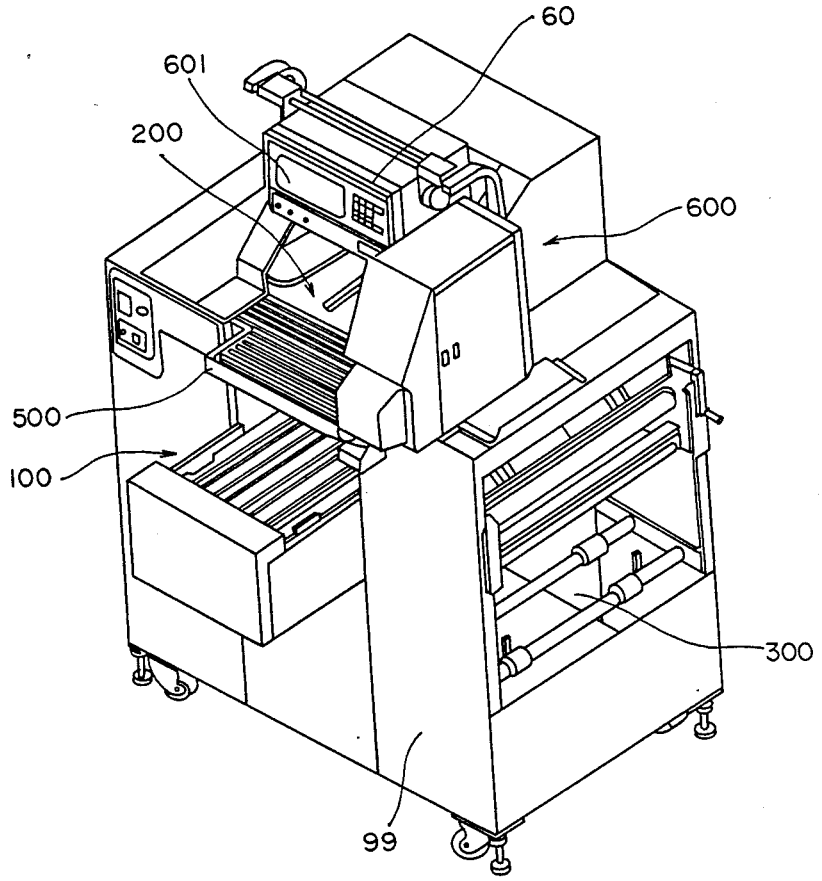
FIG. 6 shows the external appearance of the wrapping apparatus.

FIG. 6 shows the external appearance of the wrapping apparatus having the foregoing arrangement.

As illustrated, the wrapping apparatus comprises an infeed section 100 disposed so as to project from the front face of a machine frame 99, a wrapping section 200 above the infeed section 100, a film feeding section 300 at the right-hand side of the wrapping section 200, an elevator mechanism 400 (not shown) below the wrapping section 200, an outfeed section 500 above the infeed section 100, a label printer 600 disposed at the right-hand side of the outfeed section 500 to print a label with information such as the unit price, total, weight, etc. and affix the printed label to the wrapped article, and a console of a control and display section for inputting and displaying data which is disposed above the wrapping section 200.

Figure 7:
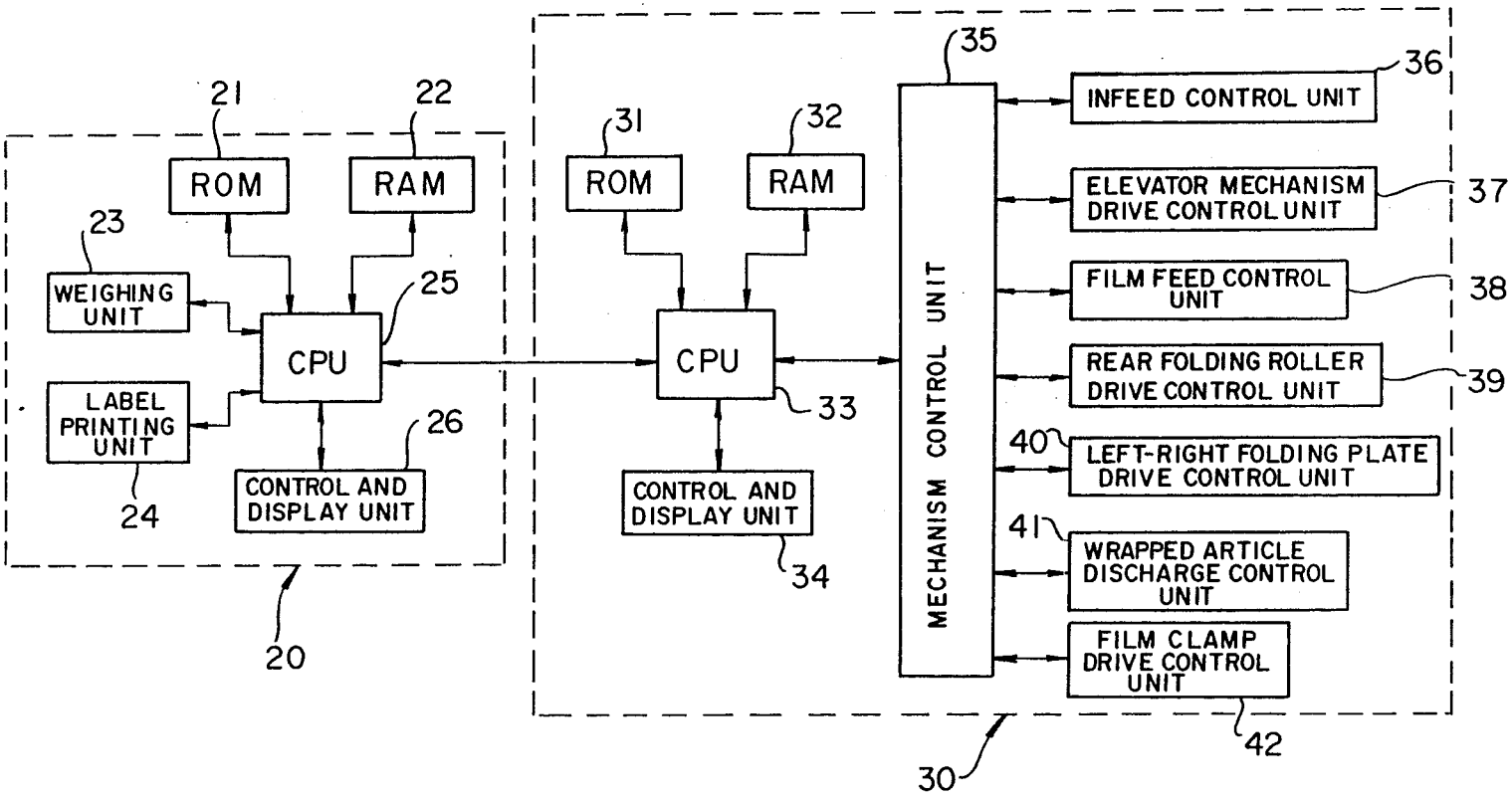
FIG. 7 is a block diagram showing the system arrangement of the control section of the wrapping apparatus.

FIG. 7 is a block diagram showing the system arrangement of a control section in the above-described wrapping apparatus.

As illustrated, the control section of the wrapping apparatus comprises a control section 20 on the side of the label printer 600 and a control section 30 on the side of the wrapping machine.

The control section 20 has ROM 21, a RAM 22, a weighing unit 23, a label printing unit 24, a CPU 25 and a control and display unit 26. The ROM 21 has a control program stored therein. The weighing unit 23 comprises the weight detecting unit 106 in the infeed section 100 and an A/D converter (not shown) and supplies weight data to the CPU 25.

The label printing unit 24 prints a label with information such as the weight, unit price, total, etc. and issues the printed label from a label issue port provided in the label printer 600. The control and display unit 26 outputs display data to a display 601 and receives data from a control panel 602.

The control section 30 has a ROM 31, a RAM 32, a CPU 33, a control and display unit 34 and a mechanism control unit 35. To the mechanism control unit 35 are connected an infeed control unit 36 that controls the infeed section 100, an elevator mechanism drive control unit 37 that controls the drive of the elevator mechanism 400, a film feed control unit 38 that controls the film feeding section 300, a rear folding roller drive control unit 39 that controls the drive of the rear folding roller 201, a left-right folding plate drive control unit 40 that controls the drive of the left and right folding plates 202 and 203, a wrapped article discharge control unit 41 that controls the outfeed section 500, and a film clamp drive control unit 42 that controls the drive of a mechanism that clamps the edge portions of the film, that is, a film clamp.

In the control section of the wrapping apparatus having the above-described arrangement, the RAM 22 in the control section 20 on the side of the label printer 600 is previously stored with data, such as the unit price of an article, its price, etc., in correspondence with the article number of each article to be wrapped, together with data representative of the type of a tray used to accommodate the article.

The ROM 31 in the control section 30 for the wrapping machine is previously stored with the operating timings $t_1$ to $t_3$ for the left and right folding plates 202 and 203 and the operating timings $t_4$ to $t_6$ for the rear folding roller 201 in accordance with the lengthwise and widthwise dimensions of various types of tray, as shown in FIG. 8.

When the control and display unit 26 is actuated to input the article number of an article to be wrapped, data such as the unit price, the name of the article, etc. corresponding to the article number is read out from the RAM 22, together with data representative of the type of a tray used to accommodate this article. The tray type data is sent to the CPU 33 in the control unit 30 via the CPU 25.

The CPU 33 reads out from the ROM 31 the operating timings of the left and right folding plates 202, 203 and the rear folding roller 201 corresponding to the tray type data delivered thereto and sends control signals to the rear folding roller drive control unit 39 and the left-right folding plate drive control unit 40 in accordance with the readout operating timings, thus activating the rear folding roller 201 and the left and right folding plates 202 and 203 at the selected timings.

Figure 9:
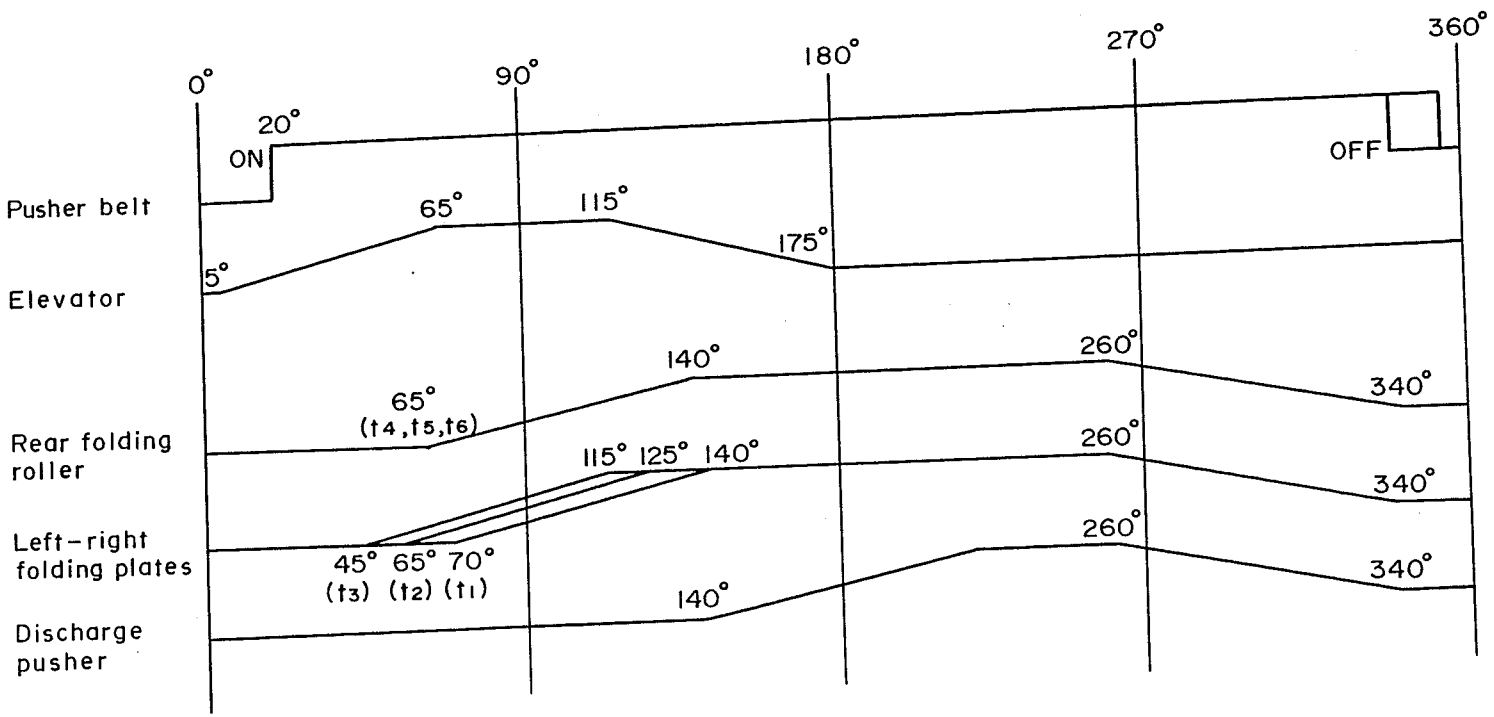
FIG. 9 is a mechanical chart showing an example of the operation of each section in the wrapping apparatus.

FIG. 9 is a mechanical chart showing an example of the operation of each section in the wrapping apparatus. In the chart, the abscissa axis represents the angle (°) of rotation of the timing disk 437 (see FIGS. 2 and 3). The wrapping apparatus is arranged such that wrapping of a single article is completed in two wrapping cycles.

When an article to be wrapped is placed on the infeed section 100, a measurement stabilizing signal or an article detecting signal is generated from the weight detecting unit 106 to start the motor 435 (at the angle 0° of the timing disk 437). The pusher belts 101 are started at a predetermined timing (at the angle 20° of the timing disk 437).

The elevator mechanism 400 begins ascending at the angle 5° of the timing disk 437, reaches the upper-limit position at the angle 65° of the timing disk 437, begins descending at the angle 115° of the timing disk 437 and reaches the lower-limit position at the angle 175° of the timing disk 437.

The rear folding roller 201 begins advancing at the angle 65° (corresponding to $t_4$, $t_5$ and $t_6$ shown in FIG. 8) of the timing disk 437, stops at the angle 140° of the timing disk 437, begins withdrawing at the angle 260° of the timing disk 437 and stops at the angle 340° of the timing disk 437.

The operation of the left and right folding plates 202 and 203 depends upon the type of a tray used. In the case of a long tray, the left and right folding plates 202 and 203 begin advancing at the angle 70° (corresponding to $t_1$ in FIG. 8) of the timing disk 437, stop at the angle 140° of the timing disk 437, begin withdrawing at the angle 260° of the timing disk 437 and stop at the angle 340° of the timing disk 437.

In the case of a standard tray, the left and right folding plates 202 and 203 begin advancing at the angle 65° (corresponding to $t_2$ in FIG. 8) of the timing disk 437, stop at the angle 125° of the timing disk 437, begin withdrawing at the angle 260° of the timing disk 437 and stop at the angle 340° of the timing disk 437.

In the case of an approximately square tray, the left and right folding plates 202 and 203 begin advancing at the angle 45° (corresponding to $t_3$ in FIG. 8) of the timing disk 437, stop at the angle 115° of the timing disk 437, begin withdrawing at the angle 260° of the timing disk 437 and stop at the angle 340° the timing disk 437.

A specific technique of detecting the angle of the timing disk 437 and controlling each section on the basis of the detected angle is mentioned in the specification of Japanese Patent Application Laid-Open Publication (KOKAI) No. 61-81912 which is an invention already filed by the applicant of this application.

Although in the foregoing embodiment the operating timings $t_4$, $t_5$ and $t_6$ of the rear folding roller 201 are the same, i.e., the angle 65° of the timing disk 437, it should be noted that the operating timings $t_4$, $t_5$ and $t_6$ may, of course, be different from each other.

Various trays which have different shapes are classified into three categories, that is, long trays that have a high length-to-width ratio, e.g., slender trays, standard trays that are used most frequently, and approximately square trays that have a low length-to-width ratio. Tray type data is stored in the memory in such a manner that any type of tray will fall into one of the three categories. For the three different types of tray, the left and right folding plates are controlled at the respective timings shown in FIG. 8. Data concerning the three types of tray may be arranged in advance so as to correspond to the tray types stated in the specification of Japanese Patent Application Laid-Open Publication (KOKAI) No. 61-190408 or, alternatively, the article numbers stated in the same specification.

It is also possible to control the system such that the speed of the left and right folding plates and the speed of the front or rear folding plate are made different from each other so that the folding plates advance to the bottom of the tray at the same timing.

As has been described above, the present invention provides the following advantages:

(1) At the time when the left and right folding members are going to fold the film under the bottom of the tray, the front or rear folding member also reaches the bottom of the tray to fold the film irrespective of the geometry of the tray selected. Therefore, the article can be wrapped in the film without applying an unnecessarily high tension to the film. Accordingly, attractively and uniformly wrapped packages are provided at all times irrespective of the shape and size of the trays and the kind of film used. Under the bottom of each tray also, the film is folded uniformly without wrinkles so that it is possible to attractively display the wrapped articles.

(2) Since the timing at which the left and right folding members are started to move can be delayed with respect to the start of the front or rear folding member, it is possible to effect control such that the front or rear folding member reaches the bottom of a slender tray having a high length-to-bredth ratio at the time when the left and right folding members fold the film under the bottom of the tray. Accordingly, the final appearance of the wrapped articles can be improved.

(3) The elevator head section of the elevator mechanism comprises left and right head portions constituted by a plurality of heads and disposed at the left and right sides, respectively, and a central head portion similarly constituted by a plurality of heads and disposed in the center, and the heads constituting the left and right head portions and the central head portion can be tilted up to a predetermined angle by the left and right folding members and the front or rear folding member in the respective directions which are at approximately 45° to the directions of advancement of the left and right folding members and the front or rear folding member. Accordingly, heads can be disposed at a high density without interference with heads disposed in the respective tilting directions and it is therefore possible to reduce the warp of the tray by the tension acting on the film and hence eliminate the fear of the tray being broken.

(4) It is possible to obtain an attractively wrapped package even by use of polyethylene film, which is less adhesive, higher in the level of restoring force occurring upon elongation and safer in terms of food hygiene than vinyl chloride film.

What we claim is:

1. A wrapping apparatus of the type in which a predetermined cut length of film fed by a film feeding mechanism is extended at a predetermined portion of the wrapping apparatus, an article to be wrapped is raised into engagement with said extended film from therebelow by an elevator mechanism, and the edges of said film are folded under the bottom of said article, thereby wrapping said article in the film, by a film folding mechanism comprising left and right folding members and either a front or rear folding member, said wrapping apparatus comprising:

an article mount section of said elevator mechanism which has at least left and right head portions disposed at the left and right sides, respectively, and each constituted by a plurality of heads;

at least one head among the heads constituting each of said left and right head portions which is closer to said front or rear folding member being arranged such that it can be tilted up to a predetermined angle by the corresponding one of said left and right folding members and either said front or rear folding member; and means for executing the starting of at least said left and right folding members and said front or rear folding member at different timings in accordance with the geometry of a tray selected to accommodate an article to be wrapped, whereby the timing at which said left and right folding members and said front or rear folding member advance to the bottom of the tray is made substantially constant irrespective of the shape of the tray.

2. A wrapping apparatus according to claim 1, wherein said means for executing the starting of said left and right folding members and said front or rear folding member at different timings comprises:

setting means for setting start timings of said left and right folding members and said front or rear folding member on the basis of preset geometric data for trays; and selecting means for selecting start timings set by said setting means in accordance with the type of a tray selected.

3. A wrapping apparatus according to claim 1 or 2, wherein, if a tray which has a relatively high length-to-width ratio is selected, the start timing of said left and right folding members is delayed with respect to the start timing of said front or rear folding member.

4. A wrapping apparatus according to claim 1, wherein at least the heads constituting the left and right head portions are arranged such that these heads can be tilted up to a predetermined angle by said left and right folding members and either said front or rear folding member in respective directions which are at approximately 45° to the directions in which said left and right folding members and said front or rear folding member advance, respectively.

5. A wrapping apparatus according to claim 1, wherein said elevator mechanism has a head section comprising a first head portion located in the center and second head portions located at both sides, respectively, of said first head portion, so that, when either the size of an article to be wrapped or the cut length of film is greater than a preset value, said first and second head portions are simultaneously raised and lowered, whereas, when the size of an article to be wrapped or the cut length of film is not greater than the preset value, said first head portion alone is raised and lowered.

6. A wrapping apparatus according to claim 4, wherein at least one of the heads constituting each of the left and right head portions of said elevator mechanism has a substantially trapezoidal planar configuration which tapers in the tilting direction.

7. A wrapping apparatus according to claim 1 or 2, wherein, if a tray which has a relatively high length-to-width ratio is selected, the speed of said left and right folding members is made lower than the speed of said front or rear folding member.

8. A wrapping apparatus according to claim 1, wherein drive sources for said left and right folding members and said front or rear folding member are provided separately from each other.

9. A wrapping apparatus according to claim 1, wherein an outfeed section for feeding out an article which has already been wrapped is disposed above an infeed section for feeding in an article to be wrapped, said infeed section being provided with a weight detecting unit for detecting the weight of an article to be wrapped which is fed thereinto, and a label printer and a console are disposed in the vicinity of said outfeed section so that said label printer issues a label printed with weight data delivered from said weight detecting unit and various data input from a control panel on said console.

10. A wrapping apparatus according to claim 1, wherein the film in which said article is wrapped is a polyethylene film.

* * * * *